United States Patent [19]

Shriver

[11] Patent Number: 4,753,167

[45] Date of Patent: Jun. 28, 1988

[54] VIBRATOR ROLL ASSEMBLY FOR INK SUPPLY AND TRANSFER APPARATUS

[75] Inventor: Frank L. Shriver, Lakewood, Colo.

[73] Assignee: Adolph Coors Company, Golden, Colo.

[21] Appl. No.: 69,283

[22] Filed: Jul. 1, 1987

[51] Int. Cl.[4] ..... B41F 31/14; B41L 27/16

[52] U.S. Cl. ..... 101/426; 101/348; 101/DIG. 14

[58] Field of Search ..... 101/348, 349, 350, 148, 101/DIG. 14, 205, 206, 207, 353, 354, 359, 360; 118/238, 241, 240, 242, 244, 258

[56] References Cited

U.S. PATENT DOCUMENTS

| | | | |
|---|---|---|---|
| 1,450,269 | 4/1923 | Walser et al. | 101/DIG. 14 |
| 2,085,185 | 6/1937 | Crafts | 101/DIG. 14 |
| 2,506,778 | 5/1950 | Crafts et al. | 101/348 |

*Primary Examiner*—J. Reed Fisher
*Attorney, Agent, or Firm*—Klaas & Law

[57] ABSTRACT

A vibrator roll assembly for use in spreading, smoothing and transferring wet ink within a wet ink transfer system of a printing and decorating apparatus wherein a vibrator roll is mounted on a shaft that is supported in a fixed support plate for rotational and reciprocal movement relative thereto. The shaft is rotated by a connecting assembly and a first portion of a reciprocating assembly is attached to the shaft for rotation therewith. A second portion of the reciprocating assembly is mounted on the connecting assembly for rotation relative thereto. The first portion and the second portion of the reciprocating assembly are rotated to have different rotational speeds. Actuating apparatus on the first and second portions are responsive to the difference in the rotational speeds thereof to reciprocate the shaft.

20 Claims, 2 Drawing Sheets

VIBRATOR ROLL ASSEMBLY FOR INK SUPPLY AND TRANSFER APPARATUS

FIELD OF THE INVENTION

The present invention relates generally to ink supply and transfer apparatus such as that employed in beverage can decorating apparatus, and in particular to a vibrator roll assembly for use in spreading, smoothing and transferring wet ink to various form rolls and transfer rolls.

BACKGROUND OF THE INVENTION

In the printing and decorating art where ink is applied to a recipient surface by a printing plate of a high speed apparatus, the ink so applied must be of a consistency and uniformity on the printing plate so that precision transfer of the ink from the plate to the recipient surface can occur. In the can decorating art, for example, ink which originates from an ink fountain means is transferred through a series of roll assemblies before reaching a blanket segment for final application to the can surface. The various roll assemblies, which generally include at least one vibrator roll assembly, act to prepare the physical characteristics required of the ink to achieve its satisfactory application in the decoration of the can surface. The can decorating apparatus taught, for example in copending and commonly-assigned U.S. patent application Ser. No. 916,604, filed Oct. 8, 1986, and incorporated herein by reference, describes a series of roll assemblies employed in ink supply and transfer.

Because the ink must be uniformly spread when it reaches the printing plate for ultimate application to the decorated surface, vibrator roll assemblies are used. In such an assembly, the vibrator roll must not only rotate, but also oscillate simultaneously to thereby effectuate a smooth and uniform ink distribution. Usual ratios of shaft revolution per oscillation generally range from about 5:1 to 30:1.

SUMMARY OF THE INVENTION

The invention provides a vibrator roll assembly which simultaneously rotates and oscillates for use in spreading and smoothing wet ink within an ink transfer system in which the ratio of shaft revolutions per oscillation may be readily and precisely controlled by a relatively simple mechanism.

In a preferred embodiment of the invention, the vibrator roll assembly, comprising a vibrator roll having an outer surface for spreading, smoothing and transferring wet ink, is secured to a shaft means which is mounted in a support plate means for rotational and reciprocal movement relative thereto. A first drive means is provided and a connecting means connects the first drive means and the shaft means to rotate the shaft means in the support plate means. A reciprocating means is provided and comprises a first portion that is secured to the shaft means for rotation therewith and a second portion of the reciprocating means which is rotatably connected to the connecting means for rotation relative thereto. A second drive means is provided and drives the second portion of the reciprocating means to have a rotational speed that differs from the rotational speed of the connecting means. An axially inclined cam slot is formed in the first portion of the reciprocating means and a cam follower, attached to the second portion of the reciprocating means, is positioned in the cam slot. Since the first portion rotates at a speed different from the second portion, the cam follower and the cam slot function to reciprocate the shaft means and provide the reciprocal movement to the vibrator roll.

BRIEF DESCRIPTION OF THE DRAWING

An illustrative and presently preferred embodiment of the invention is shown in the accompanying drawing in which.

DETAILED DESCRIPTION OF THE INVENTION

Figure 1:
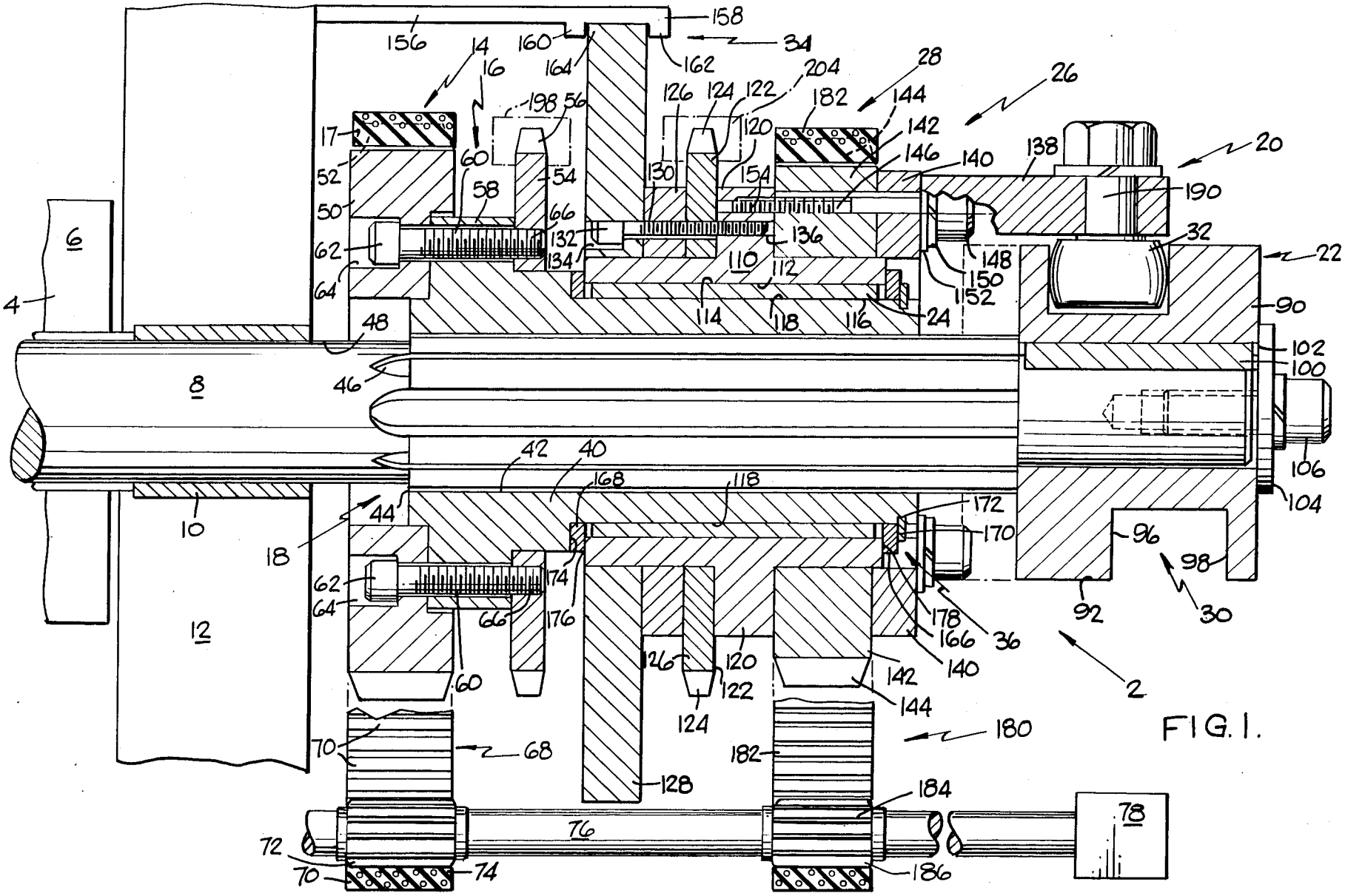
FIG. 1 is a view with parts in section of a vibrator roll assembly of this invention.

A preferred embodiment of the invention is illustrated in FIG. 1 and comprises a vibrator roll assembly 2 having a vibrator roll 4 having an outer surface 6 for use in spreading, smoothing and transferring wet ink within a wet ink transfer system for a printing and decorating apparatus (not shown). The vibrator roll 4 is secured to a shaft means 8 for rotation therewith. The shaft means 8 is mounted in a bearing means 10 secured to a support plate means 12 which is mounted in a fixed location so that the shaft means 8 can have rotational and reciprocal movement relative to the support plate means 12. A first drive means 14 is provided and a connecting means 16 extends between the first drive means 14 and the shaft means 8. Spline connection means 18 are used to mount the connecting means 16 on the shaft means 8 so that the connecting means 16 can rotate the shaft means 16 and permit axial movement therebetween. Reciprocating means 20 are provided and comprise a first portion 22 which is secured to the shaft means 8 for rotation therewith. Bearing means 24 connect a second portion 26 of the reciprocating means 20 to the connecting means 16 for rotation relative thereto. A second drive means 28 is provided and is used to rotate the second portion 26. The first and second drive means 14 and 28 rotate the connecting means 16 and the second portion 26 at different rotational speeds so that an axially inclined container cam slot 30 in the first portion 22 and a cam follower 32 attached to the second portion 26 cooperate to provide the reciprocal movement of the shaft means 8, as described more fully below. Retaining means 34 are provided for preventing axial movement of the second portion 26 and retaining means 32 are provided for preventing axial movement of the connecting means 16.

The connecting means 16 comprise a hub 40 having a generally cylindrical inner surface 42 having a plurality of longitudinally extending keyways 44 formed therein. A plurality of keys 46 project radially outwardly from the generally cylindrical outer surface 48 of the shaft means 8 and are located to mate with the keyways 44. The keys 46 and the keyways 44 provide for the rotational movement of the shaft means 8 and allow for the reciprocal movement thereof. A sprocket means 50 having teeth 52 and a sprocket means 54 having teeth 56 are secured in spaced apart relationship to an annular rib 58 projecting radially outwardly from the hub 40 by a plurality of bolts 60. The bolts 60 have head portions 62 seated in recesses 64 and threaded ends 66 threadedly connected to the sprocket 54. The first drive means 14 comprises a timing chain 68 having teeth 70 located to mesh with the teeth 52. A sprocket means 72 having teeth 74 is attached to a shaft means 76 for rotation therewith which shaft means 76 is rotated by conventional means 78. As illustrated in FIG. 1, rotation of the shaft means 76 moves the timing chain 68 which rotates the sprocket means 50 which rotates the hub 40 to rotate the shaft means 8.

The first portion 22 of the reciprocating means 20 comprises a member 90 having a generally cylindrical outer surface 92. The axially inclined continuous cam slot 30 extends radially inwardly from the outer surface 92 and has oppositely facing continuous cam surfaces 96 and 98. A radially outwardly projecting key 100 is provided on the shaft means 8 and is received in a radial keyway 102 in the member 90 so that the member 90 rotates with the shaft means 8. A washer 104 and a threaded bolt 106 are used to secure the member 90 to the shaft means 8.

The second portion 26 of the reciprocating means 20 comprises a hub 110 having a generally cylindrical inner surface 112 mounted on a generally cylindrical outer surface 114 of the bearing means 24 which also has a generally cylindrical inner surface 116 mounted on a generally cylindrical outer surface 118 of the hub 40. The bearing means 24 are fixedly mounted on the hub 40 so that the hub 110 can rotate on the bearing means 24. The hub 110 has a radially outwardly projecting annular rib 120. A sprocket means 122 having teeth 124, an annular spacer means 126 and an annular member 128 are secured to the annular rib 120 by a plurality of bolts 130 having a head 132 seated in a recess 134 in the annular member 128 and a threaded end 136 threadedly secured in the annular rib 120 so that they rotate with the hub 110. A cam follower support means 138, an annular spacer 140 and a sprocket means 142 having teeth 144 are secured to the annular rib 120 by a plurality of bolts 146 having a head 148 seated against a washer 150 which is seated against a flange 152 of the cam follower support means 138 and a threaded end 154 threadedly secured in the annular rib 120 so that rotation of the sprocket means 142 rotates the hub 110.

The retaining means 34 comprises an arm 156 secured to the support plate means 12 and extending axially outwardly therefrom so as to have an end portion 158 located radially above the annular member 128. Two spaced apart retaining members 160 and 162 project outwardly from the arm 156 and are located so that the outer portion 164 of the annular member 128 is positioned therebetween. The retaining members 160 and 162 are in contact with the outer portion 164 so as to prevent axial movement of the annular member 128 and therefore also to prevent axial movement of the second portion 26 of the reciprocating means 20.

The retaining means 36 for preventing axial movement of the connecting means 16 includes a pair of spaced apart thrust washers 166 and 168 mounted on the outer surface 118 of the hub 40. An annular retaining ring 170 is seated in annular recess 172 in the hub 40 so that it is prevented from axial movement relative to the hub 40. The thrust washer 168 is in abutting relationship with an annular radially extending surface 174 of the hub 40 and a portion of the end surface 176 of the hub 120 and the thrust washer 166 is in abutting relationship with a portion of the other end surface 178 of the hub 120 and the retaining ring 170 so as to prevent axial movement of the hub 40 and therefore also to prevent axial movement of the hub 40.

The second drive means 28 for rotating the second portion 26 of the reciprocating means 20 comprises a timing chain 180 having teeth 182 located to mesh with the teeth 144 of the sprocket means 142. A sprocket 184 having teeth 186 is attached to the shaft means 76 for rotation therewith. As illustrated in FIG. 1, rotation of the shaft means 76 moves the timing chain 180 which rotates the sprocket means 142 to rotate the second portion 26 of the reciprocating means. The cam follower 32 is rotatably mounted on an axle 190 secured in the cam follower support means 138. The cam follower 32 is positioned in the cam slot 30 so as to have rolling contact over the cam surfaces 96 and 98. As described below, the second portion 26 has a rotational speed that differs from the rotation speed of the connecting means 16 and the shaft means 8. Since the first portion 22 of the reciprocating means 20 is connected to the shaft means 8 for rotation therewith, there is a difference in the rotational speeds of the first and second portions 22 and 26 of the reciprocating means 20. This difference in rotational speeds causes relative movement between the cam follower 32 and the cam surfaces 96 and 98 to impart a reciprocating movement to the shaft means 8.

Figure 2:
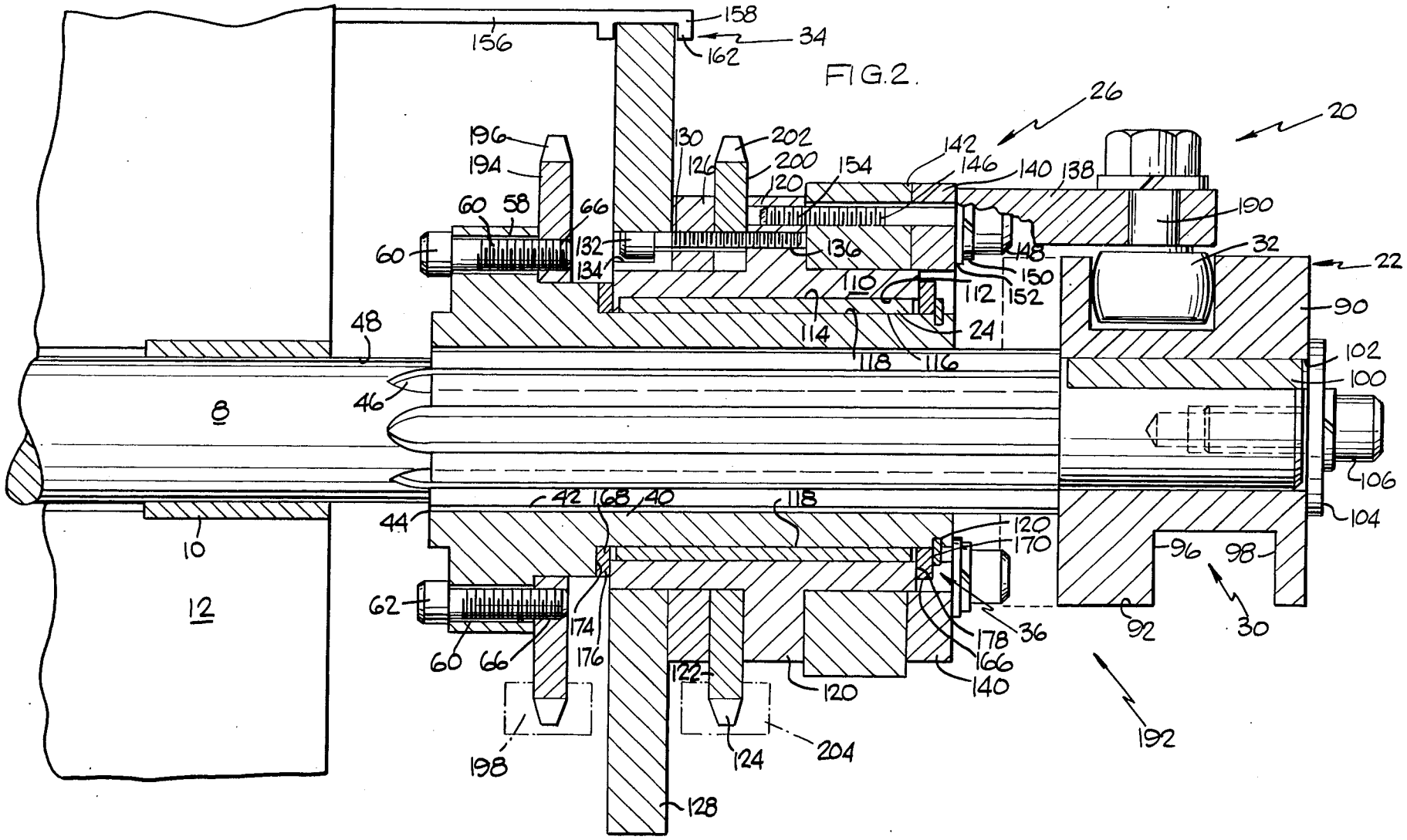
FIG. 2 is a view with parts in section of a vibrator roll assembly which is driven by the vibrator roll assembly of FIG. 1.

In FIG. 2, there is illustrated another vibrator roll assembly 192 which is very similar to that illustrated in FIG. 1 and the corresponding parts are identified with the same reference numerals. As explained below, the vibrator roll assembly 192 of FIG. 2 is driven by the vibrator roll assembly 2 of FIG. 1. The connecting means 16 of the vibrator roll assembly 192 has a sprocket means 194 having teeth 196 and wherein the sprocket means 194 are rotated by a timing chain 198 which is journaled around the sprocket means 198 and the sprocket means 54 of FIG. 1. The second portion 26 of the vibrator roll assembly 192 has a sprocket means 200 having teeth 202 and wherein the sprocket means 200 are rotated by a timing chain 204 which is journaled around the sprocket means 200 and the sprocket means 122 of FIG. 1. The vibrator roll assembly 192 operates the same as the vibrator roll assembly 2 in that the sprocket means 194 provides the rotational movement to the shaft means 8 and the sprocket means 200 provides the rotational speed to the second portion 26. The sprocket means 200 has a rotational speed that differs from the rotational speed of the sprocket means 194 to provide the reciprocating movement to the shaft means 8 through the cooperation of the cam slot 30 and the cam follower 32 as described above.

The ratio of the number of revolutions of the shaft means 8 for each complete reciprocating movement thereof may be varied as desired by varying the number of teeth in the sprocket means 50 and 142 and their associated drive sprockets 72 and 184. In one example, the sprocket means 50 has forty-four teeth and the sprocket 72 has twenty-five teeth so that the ratio is 25/44 or 0.57. The sprocket means 142 has forty-two teeth and the sprocket 184 has twenty-three teeth for a ratio of 23/42 or 0.55. The rotation to reciprocation ratio therefore is 0.57/0.55 or 1.038. One complete reciprocation, back and forth, occurs when the difference between the number of revolutions of the sprocket means 50 and 142 equals one:

x=number of revolutions of the sprocket means 50 x−1=number of revolutions of the sprocket means 142

$$\frac{x}{x-1} = 1.038$$

$$x = 27.6$$

-continued $$x - 1 = 26.6$$

Therefore, the vibrator roll 6 rotates 27.6 times for each complete reciprocation thereof.

The sprocket means 54 of the vibrator roll assembly 2 has thirty teeth and the sprocket means 194 of the vibrator roll assembly 192 has thirty teeth. Therefore, the rotation ratio of the sprocket means 194 is the same as sprocket means 54 which is 0.57. The sprocket means 122 has thirty teeth while the sprocket means 200 has thirty-one teeth. Therefore, its rotation ratio is 23/42×30/31 or 0.53. The rotation to reciprocation ratio in 0.57/0.53 or 1.072.

x=number of revolutions of the sprocket means 194 x−1=number of revolutions of the sprocket means 200

$$\frac{x}{x-1} = 1.072$$

$$x = 14.86$$

$$x - 1 = 13.86$$

Therefore, the vibrator roll 6 of the vibrator roll assembly rotates 14.86 times for each complete reciprocation thereof.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A vibrator roll assembly for use in spreading, smoothing and transferring wet ink within a wet ink transfer system of a printing and decorating apparatus comprising:

roll means having an outer surface for use in spreading, smoothing and transferring wet ink;

said roll means secured to a shaft means;

a fixedly mounted support plate means;

mounting means for mounting said shaft means in said support plate for permitting both rotational and reciprocal movement of said shaft means;

first drive means;

connecting means for connecting said shaft means to said first drive means so that said first drive means rotates said shaft means in said mounting means;

reciprocating means having a first portion thereof connected to said shaft means for rotation therewith;

a second portion of said reciprocating means;

bearing means for rotatably mounting said second portion of said reciprocating means on said connecting means for rotation relative thereto;

second drive means connected to said second portion of said reciprocating means to rotate said reciprocating means on said bearing means so that said second portion of said reciprocating means has a rotational speed that differs from the rotational speed of said first portion; and actuating means on said first and second portions are responsive to the difference in the rotational speeds of said first and second portions to reciprocate said shaft means in said mounting means.

2. A vibrator roll assembly as in claim 1 wherein said actuating means comprises:

an annular axially inclined, continuous cam slot having oppositely facing cam surfaces; and a cam follower alternately contacting said oppositely facing cam surfaces to provide said reciprocating movement.

3. A vibrator roll assembly as in claim 2 wherein:

said annular, axially inclined, continuous cam slot is in said first portion of said reciprocating means.

4. A vibrator roll assembly as in claim 1 wherein said first drive means comprises:

a timing chain connected to a power source for movement by said power source;

a sprocket having a plurality of peripheral teeth secured to said connecting means; and said timing chain in contact with said peripheral teeth so that movement of said timing chain rotates said connecting means.

5. A vibrator roll assembly as in claim 4 wherein said second drive means comprises:

a timing chain connected to said power source for movement by said power source;

a sprocket having a plurality of peripheral teeth secured to said second portion; and said timing chain in contact with said peripheral teeth so that movement of said timing chain rotates said second portion.

6. A vibrator roll assembly as in claim 5 wherein said actuating means comprises:

an annular axially inclined, continuous cam slot having oppositely facing cam surfaces; and a cam follower alternately contacting said oppositely facing cam surfaces to provide said reciprocating movement.

7. A vibrator roll assembly as in claim 6 wherein:

said annular, axially inclined, continuous cam slot is in said first portion of said reciprocating means.

8. A vibrator roll assembly as in claim 1 wherein:

said rotational speed of said connecting means is greater than said rotational speed of said second portion of said reciprocating means.

9. A vibrator roll assembly as in claim 1 wherein:

said rotational speed of said connecting means is less than said rotational speed of said second portion of said reciprocating means.

10. A vibrator roll assembly as in claim 1 wherein said connecting means comprises:

a spline connection so that said connecting means will rotate said shaft means and permit said reciprocating movement of said shaft means.

11. A vibrator roll assembly as in claim 10 wherein said spline connection comprises:

a plurality of longitudinally extending a peripheral keys on said shaft means; and a plurality of mating longitudinally extending keyways in said connecting means.

12. A vibrator roll assembly as in claim 1 and further comprising:

a first driving sprocket means secured to said connecting means for rotation therewith;

a second driving sprocket means secured to said second portion of said reciprocating means;

a second vibrator roll assembly having roll means;

a first and second timing chain operatively connected to each of said first and second driving sprocket means for driving a first and a second sprocket means on said second vibrator roll assembly for providing rotational and reciprocal movement of said roll means of said second vibrator roll assembly.

13. A vibrator roll assembly as in claim 12 wherein:

said first and second driving sprocket means have the same number of teeth; and said first and second sprocket means on said second vibrator roll assembly have a different number of teeth.

14. A vibrator roll assembly as in claim 1 and further comprising:

first retaining means for preventing axial movement of said connecting means and second retaining means for preventing axial movement of said second portion of said reciprocating means.

15. A vibrator roll assembly as in claim 14 wherein said first retaining means comprises:

an annular member secured to said second portion;

a retaining member secured to said support plate and having means for preventing axial movement of said annular member and said second portion;

thrust bearings in contact with said second portion and said connecting means; and a retaining ring on said connecting means in contact with one of said thrust bearings.

16. A vibrator roll assembly as in claim 14 wherein said second retaining means comprises:

an annular member having a rim portion and secured to said second portion for rotation therewith;

an arm fixedly secured to said mounting means;

a pair of spaced apart retaining members projecting outwardly from said arm; and said rim portion located between said retaining members.

17. A vibrator roll assembly as in claim 16 wherein said actuating means comprises:

an annular axially inclined, continuous cam slot having oppositely facing cam surfaces; and a cam follower alternately contacting said oppositely facing cam surfaces to provide said reciprocating movement.

18. A method for rotating and reciprocating a roll means in a vibrator roll assembly for use in spreading, smoothing and transferring wet ink within a wet ink transfer system of a printing and decorating apparatus comprising:

mounting a roll means having an outer surface for use in spreading, smoothing and transferring wet ink on a shaft means;

mounting said shaft means in a fixedly mounted support plate for rotational and reciprocal movement relative thereto;

connecting said shaft means to a connecting means mounted for rotation by a drive means for providing said rotational movement to said shaft means;

connecting a first portion of a reciprocating means to said shaft means for rotation therewith;

mounting a second portion of said reciprocating means on said connecting means for rotation relative thereto;

rotating said second portion of said reciprocating means at a rotational speed that differs from the rotational speed of said first portion; and reciprocating said shaft means using actuating means on said first and second portions which are responsive to the difference in the rotational speeds of said first and second portions to reciprocate said shaft means.

19. A method as in claim 18 and further comprising:

rotating said second portion of said reciprocating means at a rotational speed less than the rotational speed of said connecting means.

20. A method as in claim 19 and further comprising:

mounting said connecting means to prevent axial movement thereof and mounting said second portion of said reciprocating means to prevent axial movement thereof.

* * * * *